United States Patent [19]

Tiedeken

[11] 3,956,863

[45] May 18, 1976

[54] HEAT INSULATING COMPOSITE SECTION FOR WINDOW AND DOOR FRAMES AND SIMILAR ITEMS

[75] Inventor: Heinrich Tiedeken, Gottmadingen, Germany

[73] Assignee: Swiss Aluminium Ltd., Chippis, Switzerland

[22] Filed: Feb. 3, 1975

[21] Appl. No.: 546,804

[30] Foreign Application Priority Data

Feb. 5, 1974 Germany ..... 7403844[U]

[52] U.S. Cl. ..... 52/399; 49/504

[51] Int. Cl.[2] ..... E04B 2/88; E06B 1/04

[58] Field of Search ..... 52/395, 399, 400, 401, 52/208, 235, 732; 49/504, DIG. 1

[56] References Cited

UNITED STATES PATENTS

| | | | |
|---|---|---|---|
| 2,620,525 | 12/1952 | Ketchum | 52/401 |
| 3,466,826 | 9/1969 | Gallagher et al. | 49/DIG. 1 |
| 3,566,565 | 3/1971 | Pond | 52/399 X |
| 3,694,984 | 10/1972 | Schwartz | 52/401 |

*Primary Examiner*—J. Karl Bell

*Attorney, Agent, or Firm*—Ernest F. Marmorek

[57] ABSTRACT

A heat insulating metal composite section for frames of windows, doors, facade panels etc., and a metal load bearing section and parallel to this a metal retaining section which are held together by one or more connecting pieces made of heat insulating, and somewhat springy plastic, the metal components exhibit undercut channels on their sides which face each other and in which projections of the connecting piece elastically engage and also, in which the projections of the connecting piece which engage on the load bearing section are pressed apart by a wedge which is drawn in by a screw which passes through the retaining section and the body of the connecting piece from outside.

11 Claims, 2 Drawing Figures

HEAT INSULATING COMPOSITE SECTION FOR WINDOW AND DOOR FRAMES AND SIMILAR ITEMS

The invention concerns a heat insulating, metal composite section for frames of windows, doors and facade panels and similar items, consisting of a metal load-bearing section and a parallel metal retaining section which are held together by one or more connecting pieces made of a heat insulating and somewhat springy plastic.

Most of the known composite sections of this kind suffer from the disadvantage that their manufacture is complicated and expensive. The result of this is that the units made from them have up to now, not found the wide application which should follow considering the advantages they offer i.e. good appearance, almost no maintainance costs, good heat insulation and therefore a saving in heating costs.

The object of the invention is therefore to develop a metal composite section which can be assembled out of easily produced parts, by workers who are not particularly skilled.

The proposed solution is characterized by metal component sections which exhibit undercut channels in the sides facing each other and on which the snap-fit heads of the connecting piece engage with a spring action, and by the shanks of the connecting piece being forced outwards by a wedge shaped piece which is drawn in by a screw inserted from outside through a hole in the retaining section and the body of the connecting piece.

The novelty of the invention will now be described in detail by way of example with the aid of drawings. These are:

Figure 1:
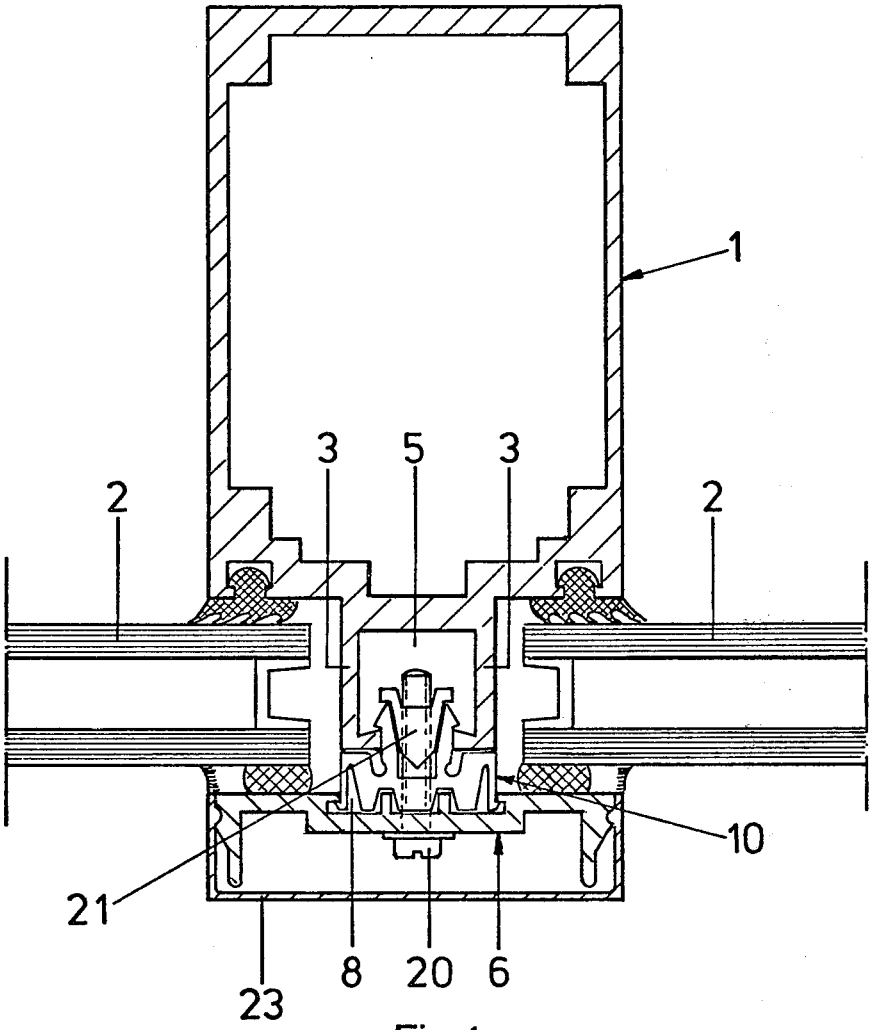
FIG. 1 is a sectional view through a shank or cross beam of a window frame of the novel composite section.
Figure 2:
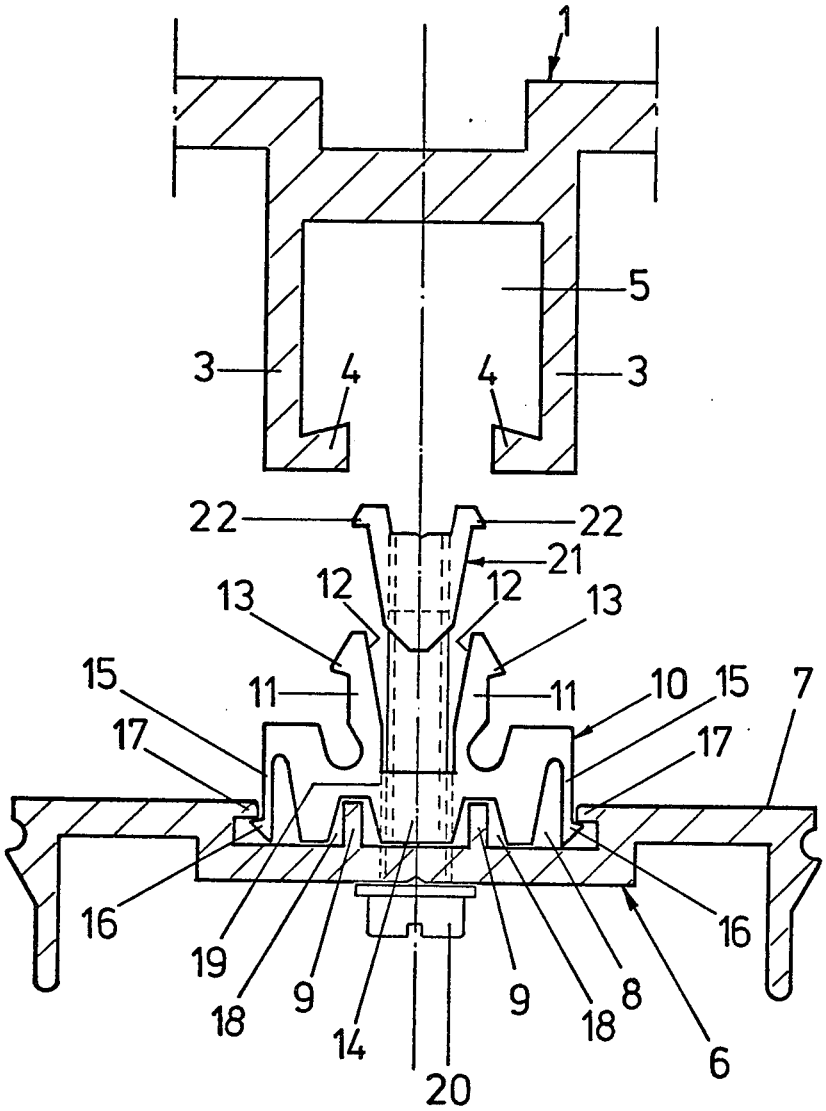
FIG. 2 is a sectional view of the main parts of the composite section before assembly into the completed composite section.

Referring now to FIG. 1 and FIG. 2, the inward facing component 1 of the composite section is the load bearing section. It has on the side facing the glass 2 two parallel, lengthwise running projections 3 which are L-shaped in cross section and the short projections 4 which face each other and form the limits to the undercut channels. The section 1 must have these L-shaped projections 3, otherwise the section can have any desired shape.

The retaining section 6 is the outer component of the composite section. This component also has in its cross piece 7 a flat undercut channel 8 which can have at its base one or more parallel guide ribs 9 running the length of the component. Here too the only essential detail is the cross piece 7 with the flat undercut channel 8, in other respects the retaining section 6 can have any desired shape in cross section.

Both metal components 1, 6 are held together by the connecting piece 10. This connecting piece can extend over the whole length of the composite section or it can be made up of several pieces of the section 10 spaced apart over the whole length of the composite section.

The connecting piece 10 is made of a rigid, somewhat springy plastic (e.g. polystyrene).

It has on the side facing the section 1 two symmetrically placed flanges 11 the surfaces 12 of which facing towards the section 1 and facing each other slope outwards, and at the free ends of these flanges 11 there are provided engaging projections 13 which point away from each other and which on assembly of the composite section engage on the short projections 4 of the L-shaped projections 3.

The flanges 11 project out of the main body 14 of the connecting piece 10. On two opposite sides of this body there are provided projections 15 which come from the side facing the section 1, point towards the retaining section 6 and run lengthwise, each projection 15 having at its free end heads 16 which face out from the plane of symmetry of the connecting piece. On assembly of the composite section these heads 16 engage in the undercut part 17 of the flat shallow channel 8 in the retaining section 6.

The side of the part 14 which faces the retaining section 6 and which is preferably in the same plane as the free edge of the projection 15, rests on the base of the flat channel 8 whereby if necessary grooves 18 can be provided in the part 14 to accommodate the guide ribs 9.

In the part 14 of the connecting piece 10 and passing completely through it in the plane of symmetry there is provided at least one hole 19 into which a screw 20 is inserted from the outside. This screw is an additional means of joining the connecting piece 10 to the retaining section 6 and prevents movement of these parts in the lengthwise direction of the composite section. Furthermore, this screw 20 serves to hold and draw tight a wedge-shaped piece 21 which is driven in between the flanges 11 of the connecting piece 10 from the section 1 side and which prevents the heads 13 from disengaging from its grip on the undercut of groove 5, which could lead to the composite section falling apart. Usefully the wedge-shaped piece 21 can exhibit on the side facing the load bearing section 1 projections 22 which face outwards and which prevent the wedge-shaped piece from going too far into the connecting piece 10.

In the example shown (FIG. 1) the retaining section is finally covered on the outside by clamping on a section 23 using well known methods.

What I claim is:

1. A heat insulating composite section of the type used for frames of doors, windows facade panels and the like, comprising, in combination, a load bearing section defining a first undercut channel;

a retaining section defining a second undercut channel;

at least one connecting piece including latching means for said first and second channels comprising normally expanded and resiliently compressable projections and being operable to engage said first and second channels, respectively, by compressing to fit into the respective channel and subsequently expanding to engage the undercut; and wedge means, including a wedge, secured to one of said sections and operable to block the compression movement of the latching means engaged in the other section.

2. In a composite section as claimed in claim 1, said retaining section further comprising guide ribs; and said connecting piece further defining guide grooves disposed essentially in the same plane as said latching means, for said first channel and operable to receive said guide ribs.

3. In a composite section, as claimed in claim 1, said wedge further comprising a collar composed of non-resilient material and being operable to exert pressure against the latching means in engagement with the section in which the latching means are blocked in a direction towards said other section.

4. A composite section, as claimed in claim 1, wherein there are a plurality of connecting pieces disposed spaced apart from each other.

5. In a composite section, as claimed in claim 2, said wedge further comprising a collar composed of non-resilient material and being operable to exert pressure against the latching means in engagement with the section in which the latching means are blocked in a direction towards said other section.

6. A heat insulating composite section of the type used for frames of doors, windows, facade panels and the like, comprising, in combination, a load bearing section having a bearing first side defining a bearing undercut channel;

a retaining section having a retaining first side disposed facing said bearing first side and defining a retaining undercut channel;

at least one connecting piece composed of partially resilient heat insulating material and comprising bearing undercut channel engaging means operable to engage said bearing undercut channel; and retaining undercut channel engaging means operable to engage said retaining undercut channel;

said retaining engaging means comprising projections with end portions operable to extend resiliently into the undercut of said retaining undercut channel;

said bearing engaging means comprising projections with end portions operable to extend resiliently into the undercut of said bearing undercut channel;

wedge means secured to said retaining section and operable to wedge said bearing engaging means and thereby retain the same in said bearing section, whereby the connecting piece acts to secure together said bearing and said retaining sections.

7. In a composite section, as claimed in claim 6, said retaining first side further comprising guide ribs pointed in the direction of said bearing section; and said connecting means further defining guide grooves disposed essentially in the same plane as said retaining undercut channel engaging means and operable to receive said guide ribs.

8. In a composite section as claimed in claim 6, said wedge means including a wedge, said wedge having a collar composed of non-resilient material and being operable to press the end of said bearing engaging means against a wall of said bearing undercut channel.

9. A composite section, as claimed in claim 6, wherein there are a plurality of connecting means disposed spaced apart from each other.

10. A heat insulating composite section of the type used for frames of doors, windows, facade panels and the like, comprising, in combination, a load bearing section defining a first undercut channel;

a retaining section defining a second undercut channel;

at least one connecting piece including first and second latching means for said first and second channels, respectively, comprising normally expanded and resiliently compressable projections and being operable to engage said first and second channels, respectively, by compressing to fit into the respective channel and subsequently expanding to engage the undercut; and wedge means, including a wedge holder engaging one of said sections, and a wedge engaging said wedge holder, said wedge bearing against said second latching means engaged in the other sections, whereby said wedge means and connecting piece cooperate to hold said sections in position.

11. A heat insulating composite section as claimed in claim 10, wherein said wedge holder comprises a rotably mounted threaded shaft, said wedge being controllably driven against said second latching means by rotation of said shaft, in a direction toward the section with which said wedge holder is engaged, whereby said sections are pressed toward each other and against said connecting means.

* * * * *